US011866130B2

(12) United States Patent
Mosgren et al.

(10) Patent No.: US 11,866,130 B2
(45) Date of Patent: Jan. 9, 2024

(54) SYSTEM FOR RESTRICTION OF HAWSER MOVEMENT IN A TANDEM MOORING AND LOADING

(71) Applicant: APL Norway AS, Kolbjørnsvik (NO)

(72) Inventors: Christian W. Mosgren, His (NO); Geir Olav Hovde, His (NO)

(73) Assignee: APL Norway AS, Kolbjørnsvik (NO)

( * ) Notice: Subject to any disclaimer, the term of this patent is extended or adjusted under 35 U.S.C. 154(b) by 485 days.

(21) Appl. No.: 17/284,364

(22) PCT Filed: Sep. 12, 2019

(86) PCT No.: PCT/NO2019/050186
§ 371 (c)(1),
(2) Date: Apr. 9, 2021

(87) PCT Pub. No.: WO2020/076160
PCT Pub. Date: Apr. 16, 2020

(65) Prior Publication Data

US 2021/0380204 A1 Dec. 9, 2021

(30) Foreign Application Priority Data

Oct. 10, 2018 (NO) ..... 20181304

(51) Int. Cl.
*B63B 21/50* (2006.01)
*B63B 21/04* (2006.01)

(52) U.S. Cl.
CPC ..... *B63B 21/50* (2013.01); *B63B 21/04* (2013.01)

(58) Field of Classification Search
CPC ..... B63B 21/50; B63B 21/04; B63B 21/56; B63B 27/34; B63B 21/00; B63B 27/24; B63B 27/30; B63B 35/44
See application file for complete search history.

(56) References Cited

U.S. PATENT DOCUMENTS 336,830 A 2/1886 Winter
6,571,723 B1 6/2003 Bech et al.
(Continued)

FOREIGN PATENT DOCUMENTS

CN 104709445 A 6/2015
NO 333956 B1 10/2013
(Continued)

OTHER PUBLICATIONS

European Patent Office, Supplementary European Search Report in counterpart European Patent Application No. 19870663.2, dated Jun. 24, 2022.
(Continued)

*Primary Examiner* — Anthony D Wiest
(74) *Attorney, Agent, or Firm* — Leydig, Voit & Mayer, Ltd.

(57) ABSTRACT

A system for restriction of hawser movement in a tandem mooring and loading system is provided comprising a first floating structure being spread moored, a second floating structure, and a tandem mooring arrangement between the first and second floating structure. The tandem mooring arrangement comprises at least one hawser connected in a first end to a hawser connection arrangement on the first floating structure, and in a second end connected to a hawser connection point on the second floating structure and a loading arrangement, wherein the system further comprises a hawser guide arrangement.

17 Claims, 17 Drawing Sheets

(56) References Cited

U.S. PATENT DOCUMENTS

| | | | | |
|---|---|---|---|---|
| 6,983,712 | B2 * | 1/2006 | Cottrell | B63B 21/50 114/230.15 |
| 8,381,699 | B2 * | 2/2013 | Karabatsos | F02B 75/32 123/197.1 |
| 2013/0279990 | A1 | 10/2013 | Nygaard | |
| 2014/0150703 | A1 | 6/2014 | Hansen et al. | |
| 2018/0093745 | A1 | 4/2018 | Vandenworm et al. | |

FOREIGN PATENT DOCUMENTS

| | | | |
|---|---|---|---|
| WO | WO 2008/127118 | A1 | 10/2008 |
| WO | WO 2011/098527 | A1 | 8/2011 |

OTHER PUBLICATIONS

International Bureau, International Search Report in International Application No. PCT/NO2019/050186, dated Dec. 3, 2019.
International Bureau, Written Opinion of the International Searching Authority in International Application No. PCT/NO2019/050186, dated Dec. 3, 2019.
International Bureau, International Preliminary Report on Patentability in International Application No. PCT/NO2019/050186, dated Dec. 10, 2020.

* cited by examiner

SYSTEM FOR RESTRICTION OF HAWSER MOVEMENT IN A TANDEM MOORING AND LOADING

CROSS-REFERENCE TO RELATED APPLICATIONS

This patent application is the U.S. National Stage of International Patent Application No. PCT/NO2019/050186, filed Sep. 12, 2019, which claims the benefit of Norwegian Patent Application No. 20181304, filed Oct. 10, 2018, which are each incorporated by reference.

TECHNICAL FIELD

The present invention relates to a system for restriction of hawser movement when mooring two vessels, in which the first vessel is spread-moored and has a mooring and loading station for connecting the second vessel in tandem via at least one mooring hawser, and where the first vessel has a hawser guide arrangement that prevents the taut hawser from clashing with the loading hose and deck equipment for a wide range of hawser directions relative the first vessel.

BACKGROUND

A commonly used and well proven technology for transferring hydrocarbons such as oil or condensate from a Floating Production, Offloading and Storage (FPSO) vessel or a Floating Storage and Offloading (FSO) vessel to an Export Tanker is by using a tandem arrangement. Future applications may also include FLNG (Floating Liquified Natural Gas) vessels and FSRUs (Floating Storage and Regasification Unit), among others. In this arrangement the FPSO/FSO is equipped with a loading station comprising a loading hose and a mooring hawser. In the connection process the loose end of the hose is transferred and connected to the Export Tanker—the other end is connected to the FPSO/FSO. Same is also done with the mooring hawser. To avoid any collision between the two vessel a tug is usually connected to the stern of the Export Tanker and pulls on the Export tanker such that the mooring hawser between the Export Tanker and the FPSO/FSO is tight.

In a typical arrangement the FPSO/FSO is turret moored. This means that when the weather (wind, wave and current) turns both the FPSO/FSO and the Export Tanker turn (weathervane), implying that the heading of the FPSO/FSO and Export Tanker are generally aligned with low risk of interference/contact with each other. Turret mooring arrangements are expensive and complex arrangements, and may not always be the preferred solution for the field development. For a spread-moored FPSO/FSO the risk of interference/collision between the two vessels is on the other hand significantly higher, because it will only be the Export Tanker that weathervanes and even with use of several tugs to keep the Export tanker clear of the FPSO/FSO it is an operation with potentially high risk for collision between the two vessels as well as increased risk for damaging the loading hose, the hawser and deck equipment on the FPSO/FSO.

Related prior art is also disclosed in U.S. Pat. No. 6,571,723B1, but this relates to a spread-moored arrangement for the Export Tanker where the spread-mooring for the Export Tanker is connected to the mooring lines for the FPSO/FSO. Other related prior art is disclosed in NO333956B1, WO2011098527A1 and CN104709445A.

One objective of the present invention is to avoid damage to the loading hose and equipment on the FPSO/FSO due to the directional rotation of mooring hawser due to large heading deviation between the spread-moored FPSO/FSO and the weather-vanning Export Tanker. Other objectives are to provide more time for a controlled disconnect of the Export Tanker and potentially also increase the operational limits for the tandem loading operation. To achieve these objectives a system according to claim 1 is provided.

SHORT SUMMARY OF THE INVENTION

The invention relates to a system for restriction of hawser movement in a tandem mooring and loading system comprising a first floating structure being spread moored, a second floating structure, and a tandem mooring arrangement between the first and second floating structure. The tandem mooring arrangement comprises at least one hawser connected in a first end to a hawser connection arrangement on the first floating structure, and in a second end connected to a hawser connection point on the second floating structure and a loading arrangement. Wherein the restriction system further comprises a hawser guide arrangement, wherein the hawser guide arrangement comprises at least two guide structures situated on either side of the hawser connection arrangement on the first floating structure, for allowing a weather-vanning sector larger than 180 degrees by hindering the at least one hawser from crossing over a deck portion of the first floating structure when the second floating structure weathervanes relative to the first floating structure.

BRIEF DESCRIPTION OF THE FIGURES

Below, various embodiments of the invention will be described with reference to the figures, in which like numerals in different figures describes the same features.

DETAILED DESCRIPTION OF THE INVENTION

Figure 1A:
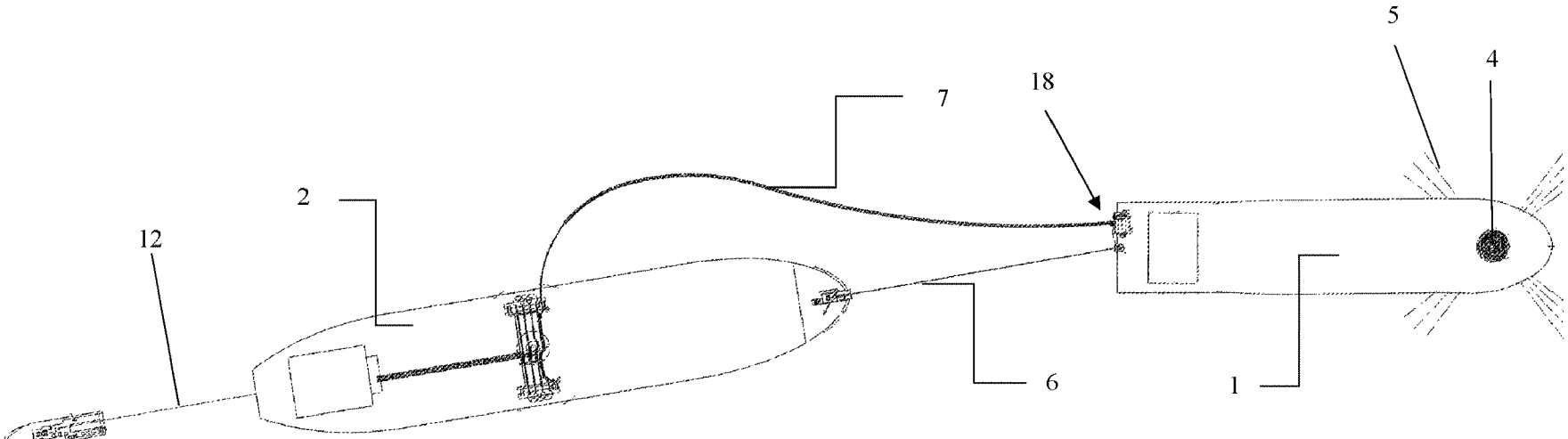
FIGS. 1*a* and 1*b* shows a top view of typical tandem loading from a turret moored vessel and a spread-moored vessel.

This invention relates to a system for preventing the mooring hawser 6 in a tandem arrangement from causing damage to deck machinery and other equipment when the heading of a first floating structure 1, such as an vessel or FPSO/FSO and the heading of a second floating structure 2, such as a tandem vessel or Export Tanker are not aligned. This system comprises a hawser guide arrangement 34 intended to protect critical equipment such as the loading hose 7 and hose reel 20. The hawser guide is shaped with a smooth surface without any sharp edges to avoid damage to the hawser itself. The guide arrangement extends in both the vertical and horizontal direction to allow the hawser 6 to have a direction relative the FPSO/FSO that follows the relative motion between a hawser connection arrangement 9 on the FPSO/FSO and a hawser connection point 11 on the Export Tanker, where the relative motion has both a vertical and horizontal component due to the varying relative heading between the two vessels as well as different draught and first order wave motions.

The protective system set forth in the following claims thus allows for larger relative heading angles between a spread moored first vessel 1 and a tandem moored second vessel 2, compared to a conventional tandem mooring system. Preferably the restriction system would allow for heading angles above ±90 degrees. Various ways to attach the mooring hawser 6 to the FPSO/FSO is also described, including an arrangement for dual hawsers. A dual hawser arrangement is commonly required if the Export Tanker exceeds a certain size.

To ease the explanation, we use an orthogonal axes system wherein the z-axis coincides with the local vertical axis of the vessel. The x-axis is in the length direction of the vessel, while the y-axis is in the beam direction of the vessel. The FPSO/FSO is also referred to as the "moored vessel" or "first floating structure", and the Export Tanker is also referred to as the "tandem vessel" or "second floating vessel". Although, words like vessel, FPSO or floating structure is used herein, the invention relates to any type of floating structures with any type of hull form, may that be a typical elongated ship hull, circular or square shaped floaters, which would be obvious for a person skilled in the art.

Figure 1B:
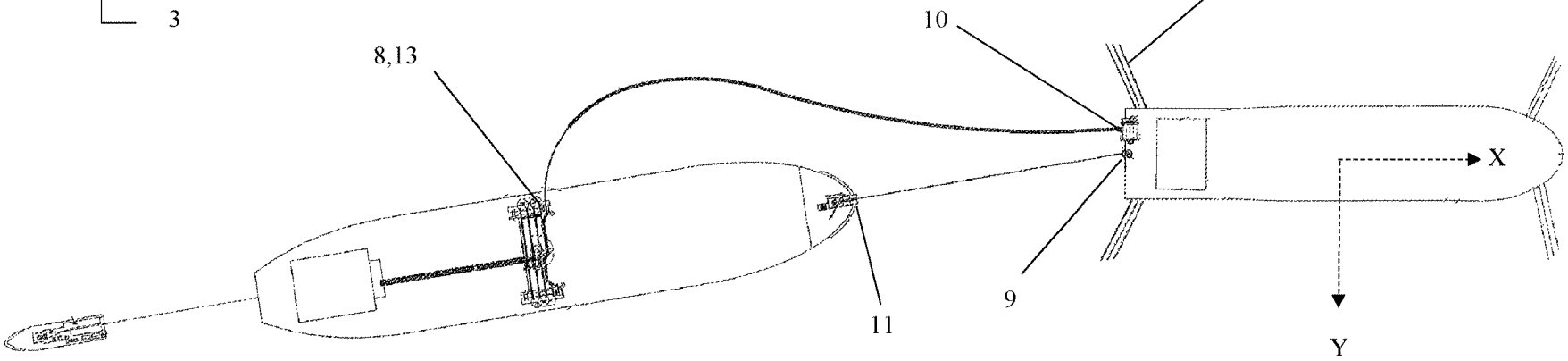

FIG. 1*a* gives an overall view of tandem loading from a moored vessel 1 with a turret 4 for weather-vanning capability. The turret is further connected to anchors 16 on the seabed 15 via mooring lines 5. A tandem vessel 2 is then connected to a loading station 18 on the moored vessel 1 via a mooring hawser 6 and a loading hose 7. The hawser is connected to the moored vessel at an arrangement 9 (typically at the stern of the moored vessel, but not necessarily) and to the tandem vessel at a point 11 (typically at the bow of the tandem vessel). The loading hose is connected to a point 10 on the moored vessel and typically to the midship manifold 8 on the tandem vessel via a hose connection point 13. A tug 3 is further connected to the stern of the tandem vessel via a tug line 12. The tug then pulls on the tandem vessel such that the mooring hawser 6 is kept tight. FIG. 1*b* shows the same as FIG. 1*a*, but the moored vessel 1 is spread-moored instead of turret-moored, implying that the moored vessel does not weathervane.

Figure 2:
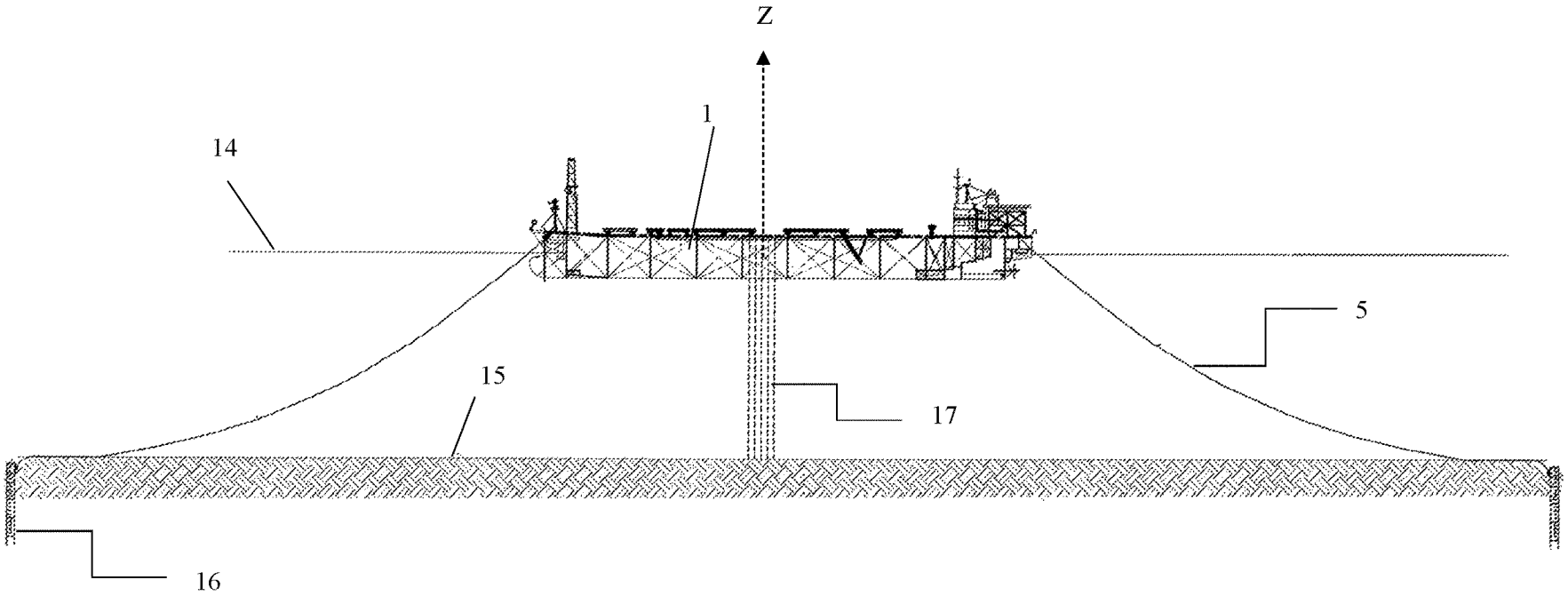
FIG. 2 shows a side view of a typical spread-moored vessel.

FIG. 2 gives an overall view of a spread-moored vessel 1 with mooring lines 5 to anchors 16 on the seabed 15. A spread-moored vessel then typically has risers 17 attached to a balcony 19 at the vessel side, in which the risers connects the vessel 1 on the sea surface 14 to subsea manifolds and flowlines on the seabed.

Figure 3:
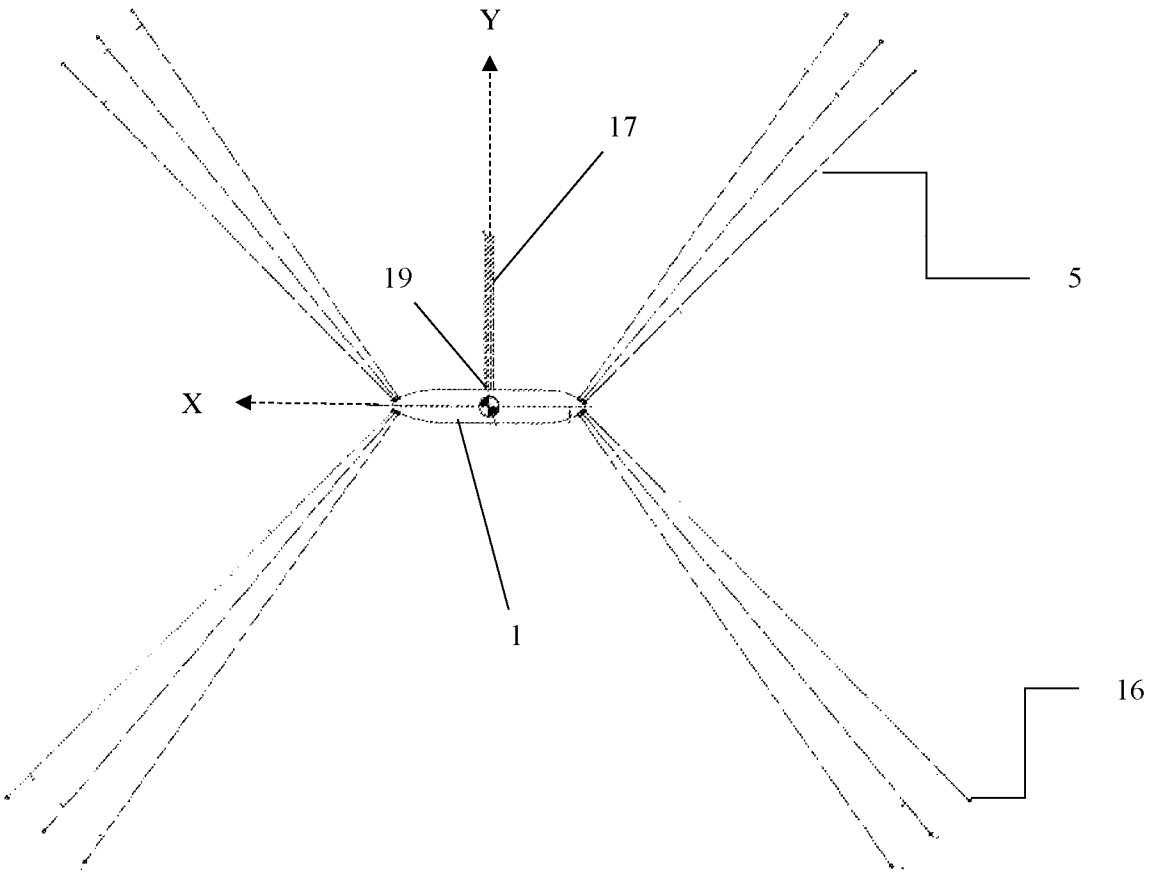
FIG. 3 shows a top view of a typical spread-moored vessel with 4 groups of 3 mooring lines.

FIG. 3 shows a typical mooring layout for a spread-moored vessel 1. In this example the vessel is moored by 12 off mooring lines 5, arranged with 3 lines in each corner of the vessel, to anchors 16 on the seabed. The figure also shows a typical direction of the risers 17 relative the vessel longitudinal axis x.

Figure 4A:
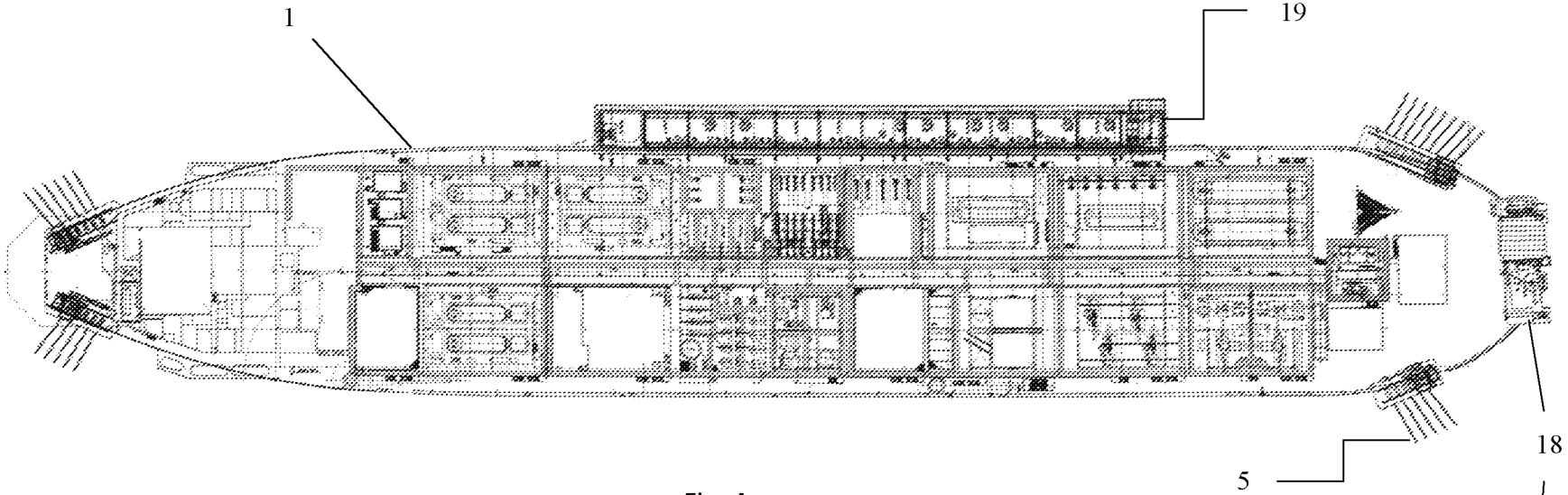
FIGS. 4*a* and 4*b* shows a typical general arrangement of a spread-moored vessel with a loading station at the bow.
Figure 4B:
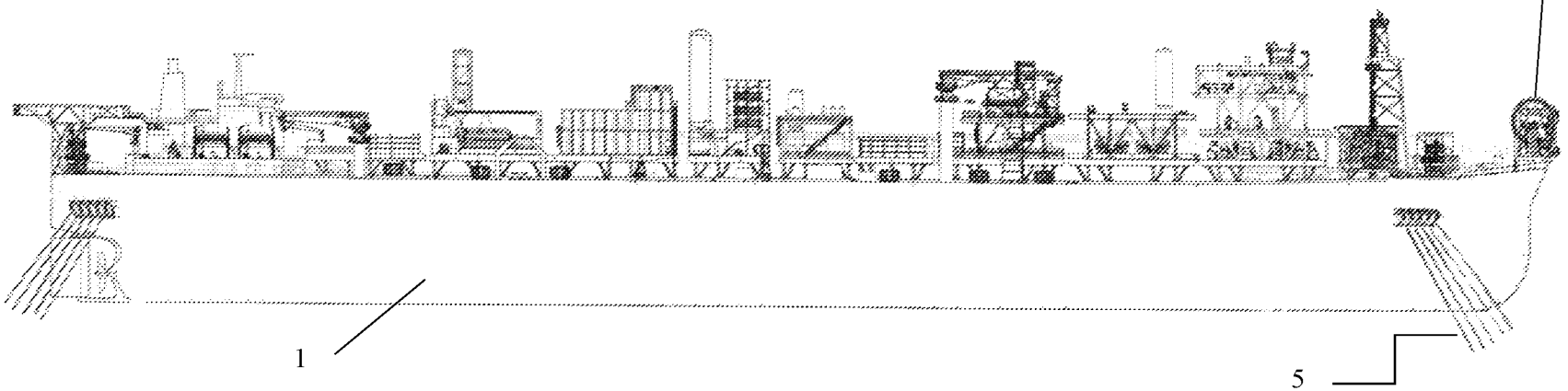

FIG. 4 shows a general arrangement of a spread-moored vessel 1 with riser balcony 19 and mooring lines 5. In this example the loading station 18 is located at the vessel bow, but it can also be located at the opposite end, i.e. the stern, or any other suitable positions.

Figure 5:
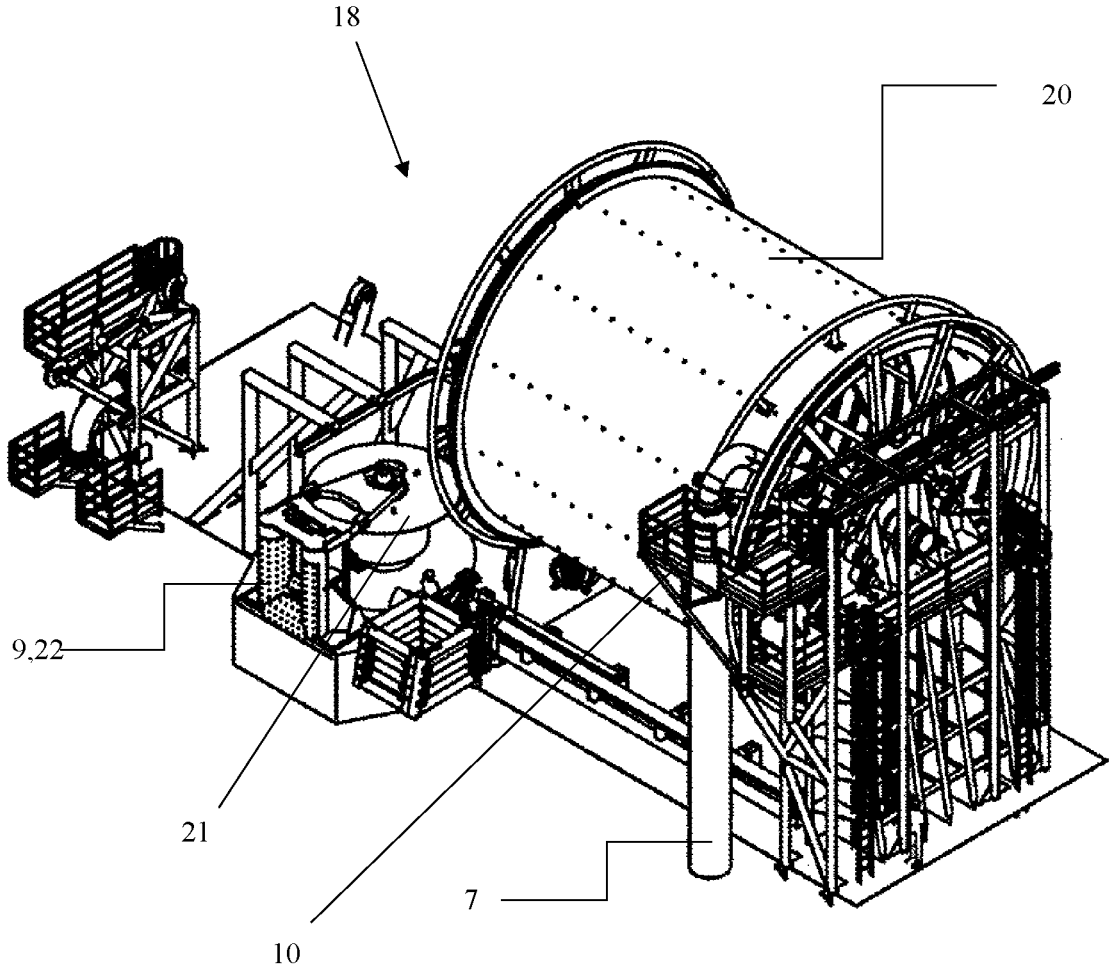
FIG. 5 shows a typical general arrangement of a typical loading station.

FIG. 5 shows a typical arrangement of the loading station 18. In this arrangement the loading hose 7 is stored on a hose reel 20, when not connected to the tandem vessel 2. When the loading hose 7 is connected to the tandem vessel most of the hose is floating in the sea, except for the ends. The end of the hose towards the loading station is typically hanging vertically down from the hose connection point 10 on the loading station from an elevation above the sea surface 14. The hawser 6 is connected to a hawser winch 21 and is routed through a fairlead 22 outside the winch.

FIG. 5 shows a hawser winch with a vertical axis of rotation, but this winch can alternatively have a horizontal axis of rotation. Further, in another embodiment the hawser winch can be replaced with a fixed lug, which implies that the hawser will float on the sea surface when not connected to the tandem vessel. In another embodiment the loading hose can also be permanently hanging down from the loading station and floating on the sea surface when not connected to the tandem vessel, or it can be stored on deck on a chute when not in use, i.e. no hose reel.

Figure 6A:
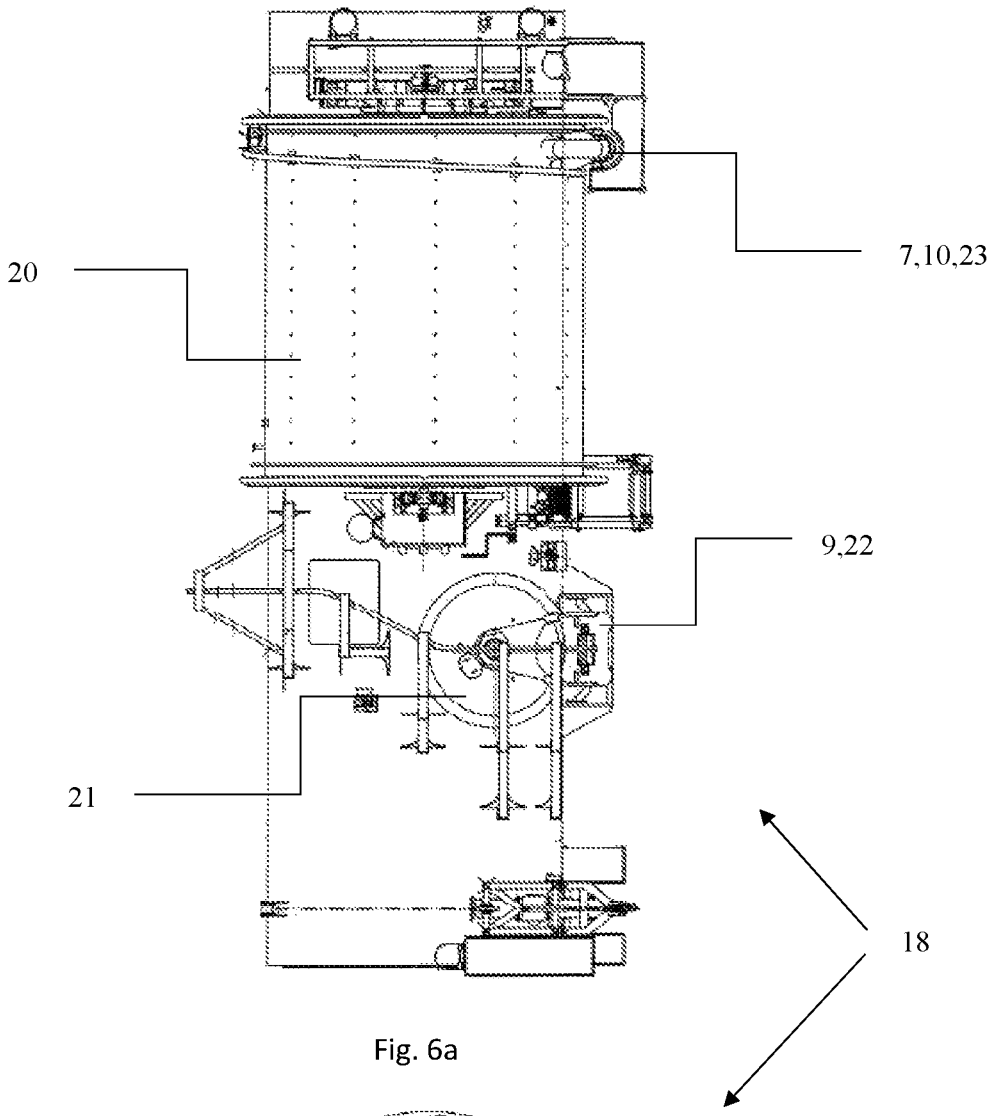
FIGS. 6*a* and 6*b* shows a top view and a side view of a typical loading station.
Figure 6B:
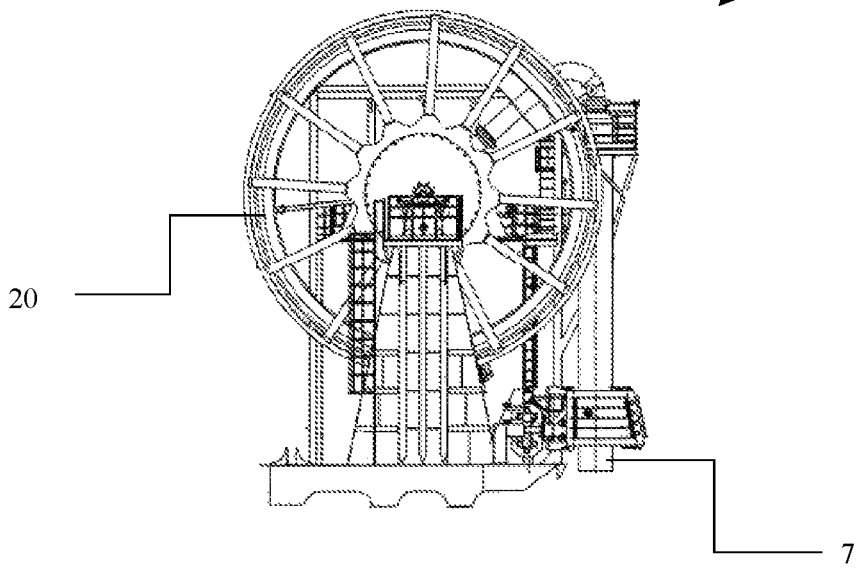

FIG. 6 shows a typical arrangement for a loading station 18, comprising a hose reel 20 with loading hose 7 and a hawser winch 21 with fairlead 22. The hose reel and hawser winch are typically positioned side-by-side as shown in the figure.

Figure 7A:
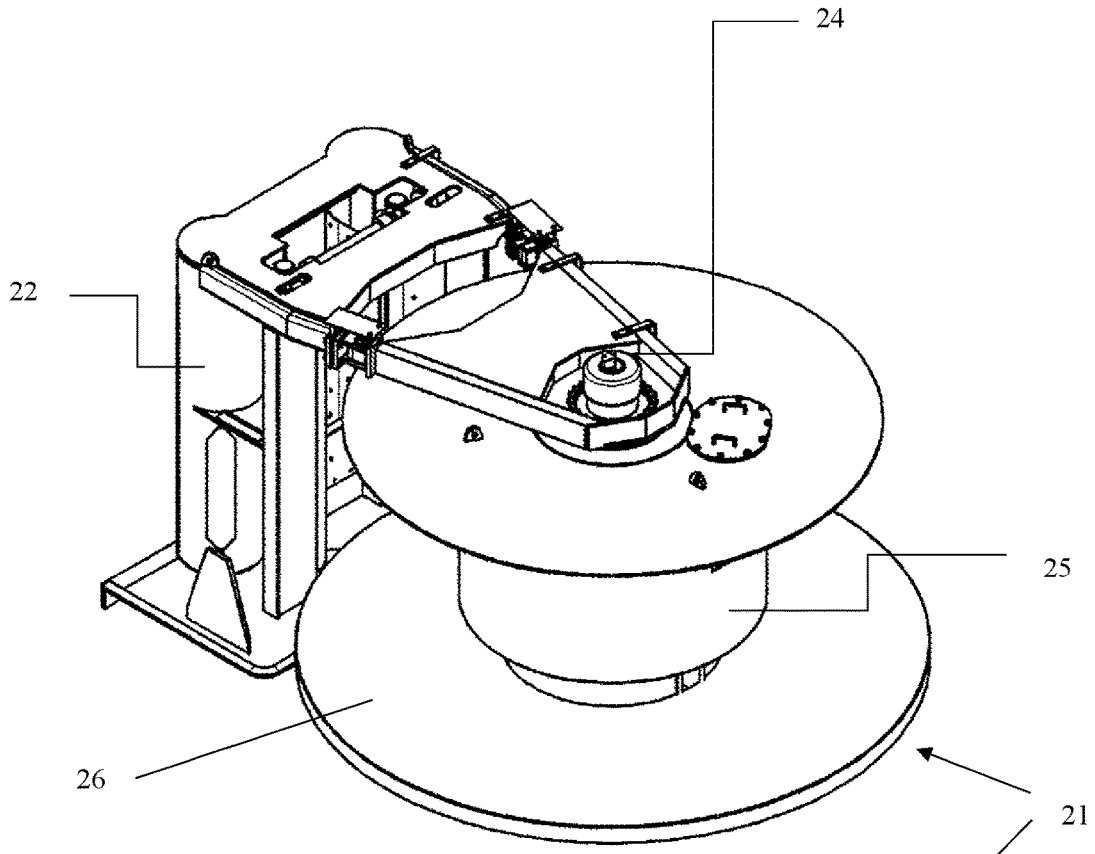
FIGS. 7*a* and 7*b* shows a typical hawser winch with a vertical axis of rotation for the storage drum.
Figure 7B:
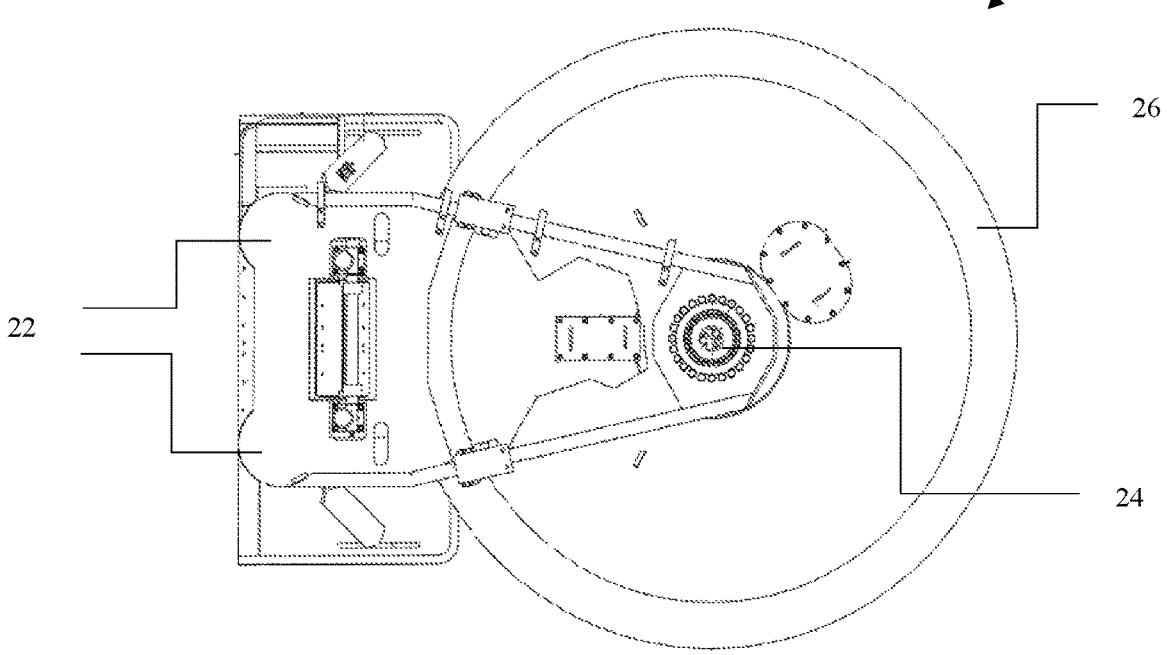

FIG. 7 shows the hawser winch 21 with vertical axle 24 for rotation. In this embodiment the hawser is stored on the drum 25 with the heavy components such as the chain 27 resting on the plate 26.

Figure 8:
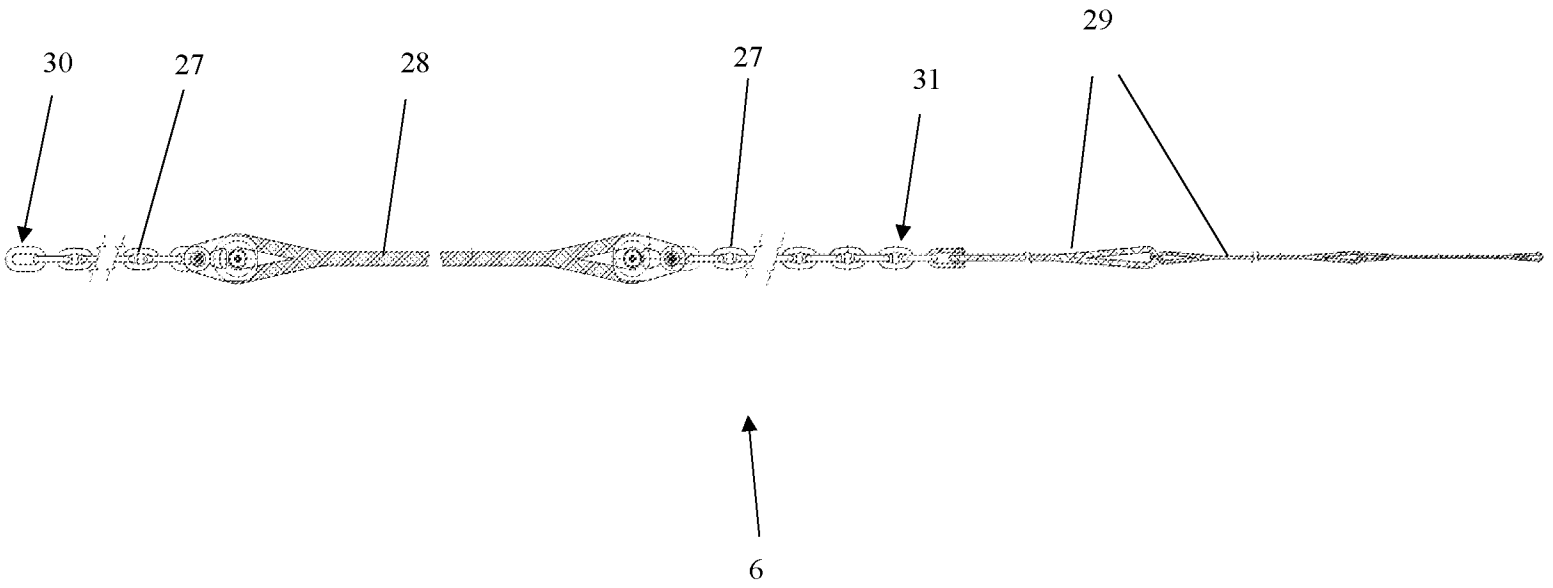
FIG. 8 shows a typical assembly of a mooring hawser.

FIG. 8 shows a typical composition of the mooring hawser 6. In this arrangement the fixed connection to the drum 25 is via a chain segment 27 at end 30. A second chain segment will at end 31 be locked to a chain stopper in the bow of the tandem tanker 2. A rope 28, typically a nylon rope, is then connecting the two chain segments to each other. During connection the tandem tanker pulls the hawser from the moored tanker 1 by pulling on a pick-up/transfer line 29.

Figure 9:
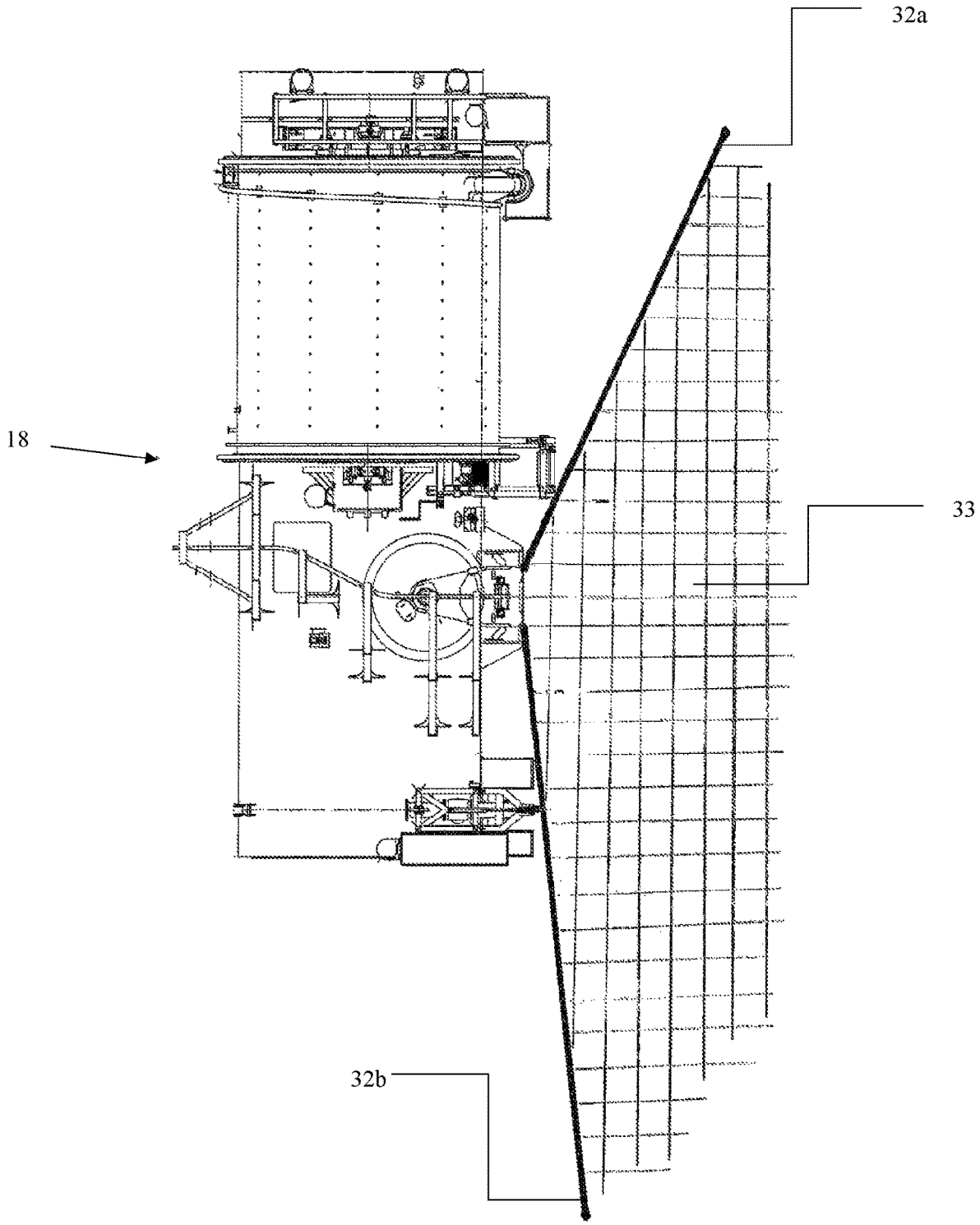
FIG. 9 illustrates a typical allowable range for the mooring hawser direction relative the loading station orientation.

FIG. 9 shows a typical working area for the hawser and thus the tandem tanker relative the moored tanker for a typical loading station. To avoid any contact between the hawser and other structures the hawser needs to be in the area 33, which has the boundary lines 32*a* and 32*b*. This area and boundary lines may differ from one arrangement to another, but typically it is an area that is narrower than +/−90 degrees. The present invention is related to means/devices that will increase this sector to beyond +/−90 degrees.

Figure 10A:
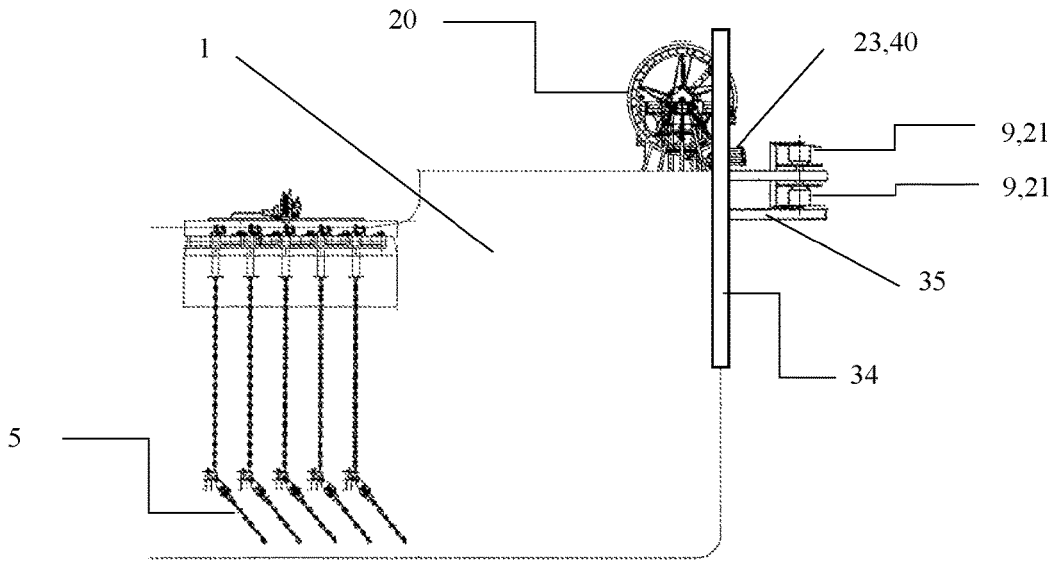
FIGS. 10*a* and 10*b* shows a principal arrangement of a loading station with hawser guides for increasing the allowable range for the mooring hawser direction.
Figure 10B:
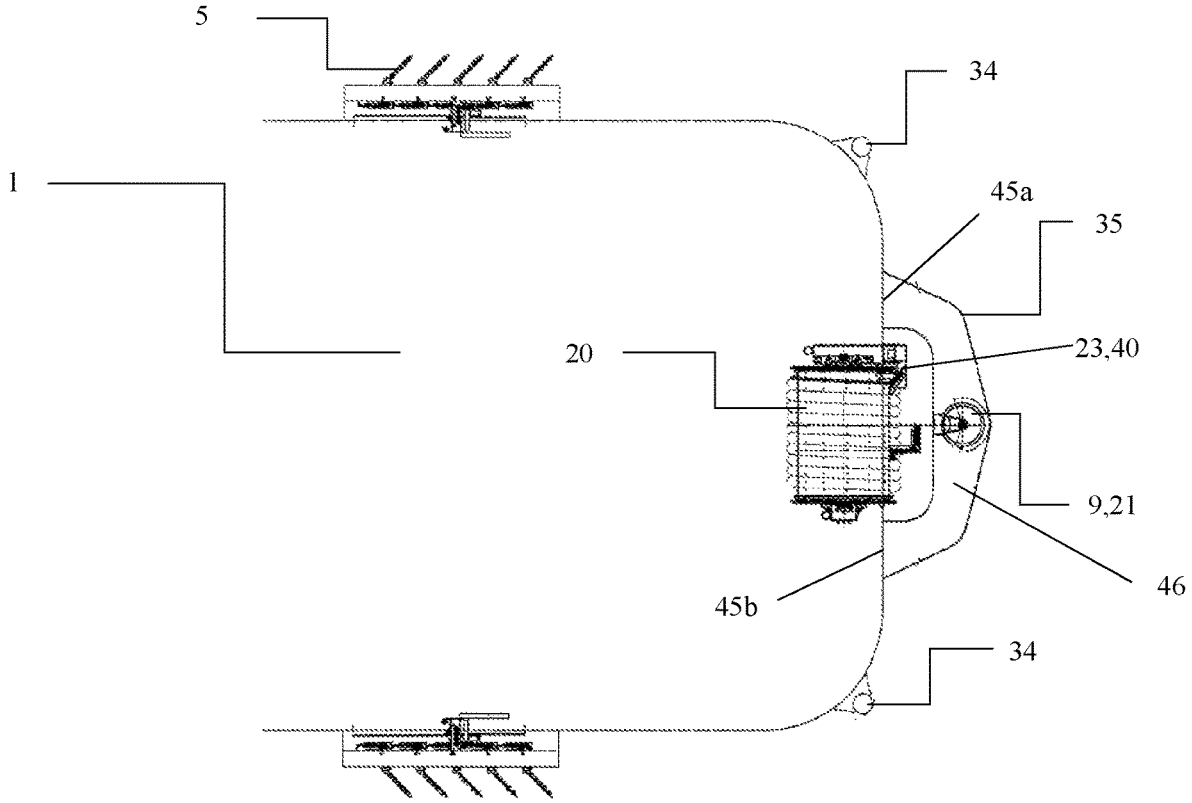

FIGS. 10*a* and 10*b* show the mooring and loading system with a working area for the mooring hawser that is wider than +/−90 degrees in the horizontal plane. In this embodiment the hawser connection arrangement 9 is located closer to nominal position of the tandem tanker 2 and connection point 11 than the hose reel 20 and the loading hose drop point 23. This means that the hawser can rotate more than +/−90 degrees in the horizontal plane before it can interfere with the hose reel and loading hose.

FIGS. 10*a* and 10*b* also shows a hawser winch support structure (35). In this embodiment the support structure comprises two attachment areas (45*a*,45*b*) horizontally spaced on either side of the hose reel (20) on the hull of the first floating vessel (1) and with a beam structure (46) between the two attachment areas (45). The beam structure between the first and second attachment areas is further spaced a distance away from the hull of the first floating vessel, forming an open space between the hull and the support structure and the first and second attachment areas, wherein said open space defines a drop-down location (23) for the loading hose (7).

In a preferred embodiment of the invention a restriction system comprising a hawser guide arrangement is arranged on a first floating structure 1. The hawser guide arrangement comprises at least two guide structures 34 situated on either side of the hawser connection arrangement 9 on the first floating structure 1. The hawser guide structures 34 are located at the border extremities of the hull of the first floating structure, and the width separating the said hawser guide structures in the y-axis direction are determined by the width of the hull where the loading system is situated.

Shown in FIGS. 10*a* and 10*b* as an example for placement on a vessel with a conventional hull shape, the loading system is situated on the stern of the vessel 1 with the restriction system comprising two hawser guide structure 34 situated on the outside of the aft starboard side and port side corner of the vessel hull, for allowing a weather-vanning sector larger than 180 degrees by hindering the at least one hawser from crossing over a deck portion of the first vessel 1 when a second vessel 2 weathervanes relative to the first vessel 1. And thereby prevent the at least one mooring hawser from hitting equipment on the vessel deck and potentially damage this equipment as well as damage the mooring hawser.

The guide structure has a smooth surface with a substantially rounded or curved shape that does not harm the mooring hawser, and it extends from below to above the elevation of the hawser connection arrangement 9. In an embodiment of the invention the hawser guides have a substantially upright column shape, as seen in FIGS. 10*a* and 10*b*. The guide structures has a height extending from a bottom end below the hawser connection arrangement 9 to a top end above the hawser connection arrangement 9, where the minimum height of the guide structure 34 are equal or higher than the vertical working range of the hawser at the location of the guide. The vertical working range of the hawser depends on the variation in the relative vertical position of connection arrangement 9 on the first vessel and the hawser connection point 11 on the second vessel, due to variation in vessel draught as well as vessel motions in waves.

Figure 16:
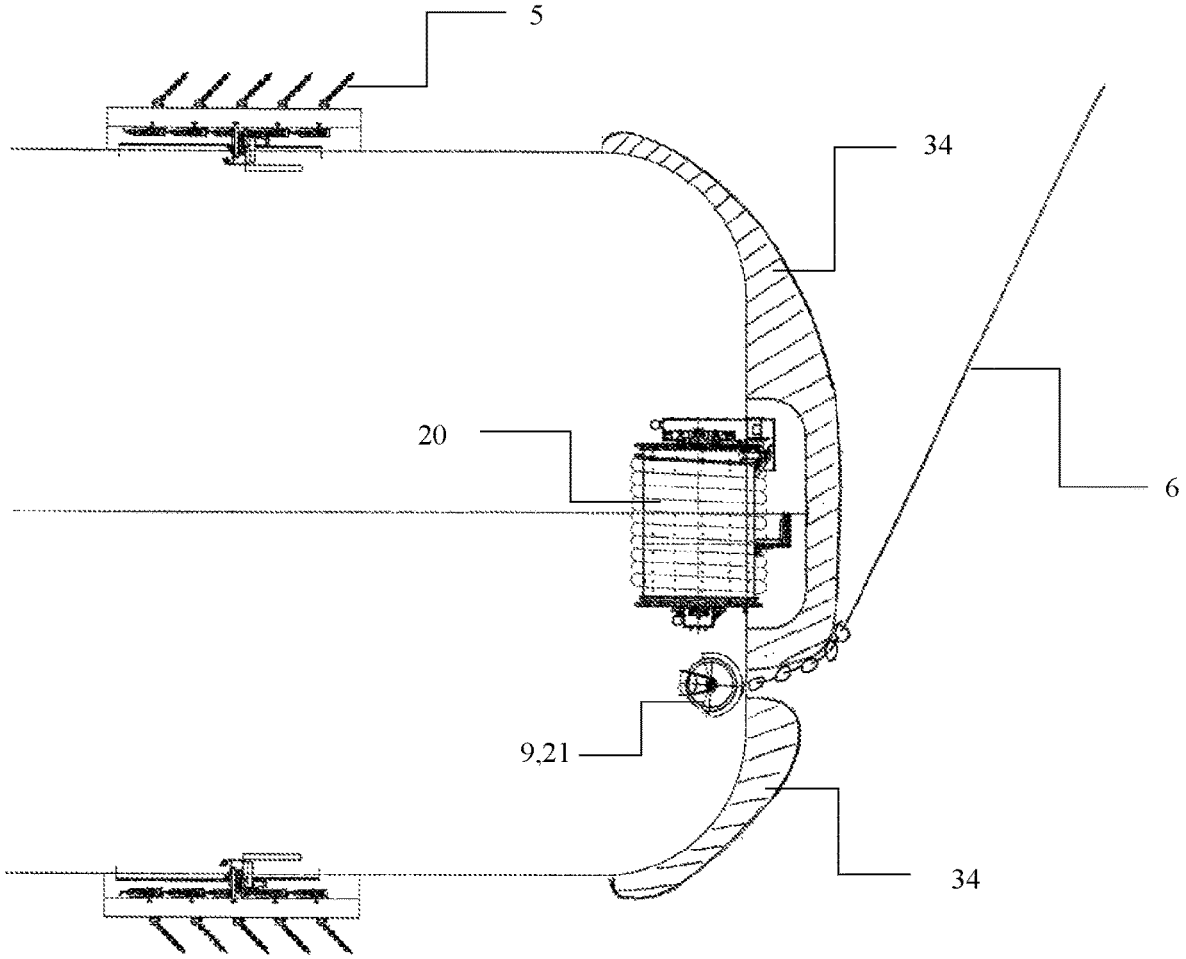
FIG. 16 shows an alternative configuration where hawser connection to moored vessel is positioned at the side of the hose reel and with continuous hawser guide structure.

The number of guide structures 34 depends on the vessel deck layout and vessel hull. Sufficient number of guides to prevent contact between the mooring hawser and vessel equipment will be installed. In a preferred embodiment at least two guide structures 34 are utilized, in another embodiment at least four guide structures 34 are utilized, and in yet another embodiment of the invention the guide structures 34 are curved plates with a horizontal width in the direction of the y-axis, extending from a first side end facing the hawser connection arrangement 9 and to a second side end extending past the horizontal extremities of the hull, as seen in FIG. 16.

The guide structures 34 can either be individual/external guides fixed to the vessel hull, such as shown in FIG. 10*a* or 10*b*, or be directly integrated in the design of the vessel hull and topside structure. Means for fixing the guides to the hull or integrating the guides into the structure of the hull would be obvious by a person skilled in the art.

Number of mooring hawsers is typically 1 or 2, depending on the size of the tandem tanker 2. FIG. 10 presents an example with two winches 21 and thus two hawsers. The two winches are in this embodiment located on top of each other such that the hawsers will get in contact with the guide structures 34 at two different elevations, but this is no necessity for the invention. Alternatives to winches 21 with a vertical axle of rotation 24 are shown in FIGS. 15*c* and 15*d*.

The loading hose 7 is typically hanging vertically from the hose reel 20 and down to the sea surface 14, where it will then float on the surface to the tandem tanker 2 via in-built or external buoyancy. The loading hose has an overlength compared to the hawser 6, which means the loading hose will typically not see very large tension loads. However, the loading hose will follow the tandem vessel when the tandem vessel weathervanes. In most cases the loading hose will have sufficient structural capacity to absorb the twist/torsion loads caused by the rotation of the tandem vessel, but in some cases it may be necessary to include a fluid swivel 40 close to the drop-down point 23 or along the hose string to reduce or avoid twisting. The hose string is typically composed of several short hose segments connected by bolted flanges, and a fluid swivel can be located between any of these hose segments.

In most embodiments the moored vessel 1 has a smooth shape hull, which will not damage the hose if the loading hose, especially the floating part, clashes with the vessel hull, e.g. due to waves pushing the hose towards the hull. If the hull has any sharp edges or other unfavorable shapes that can damage the hose then the hull should be modified to have a smooth surface and acceptable curvatures for the hose, or external guides should be added to the hull with a smooth surface and acceptable curvatures for the hose, or the hose itself should be fitted with protective means, or a combination thereof.

Figure 11:
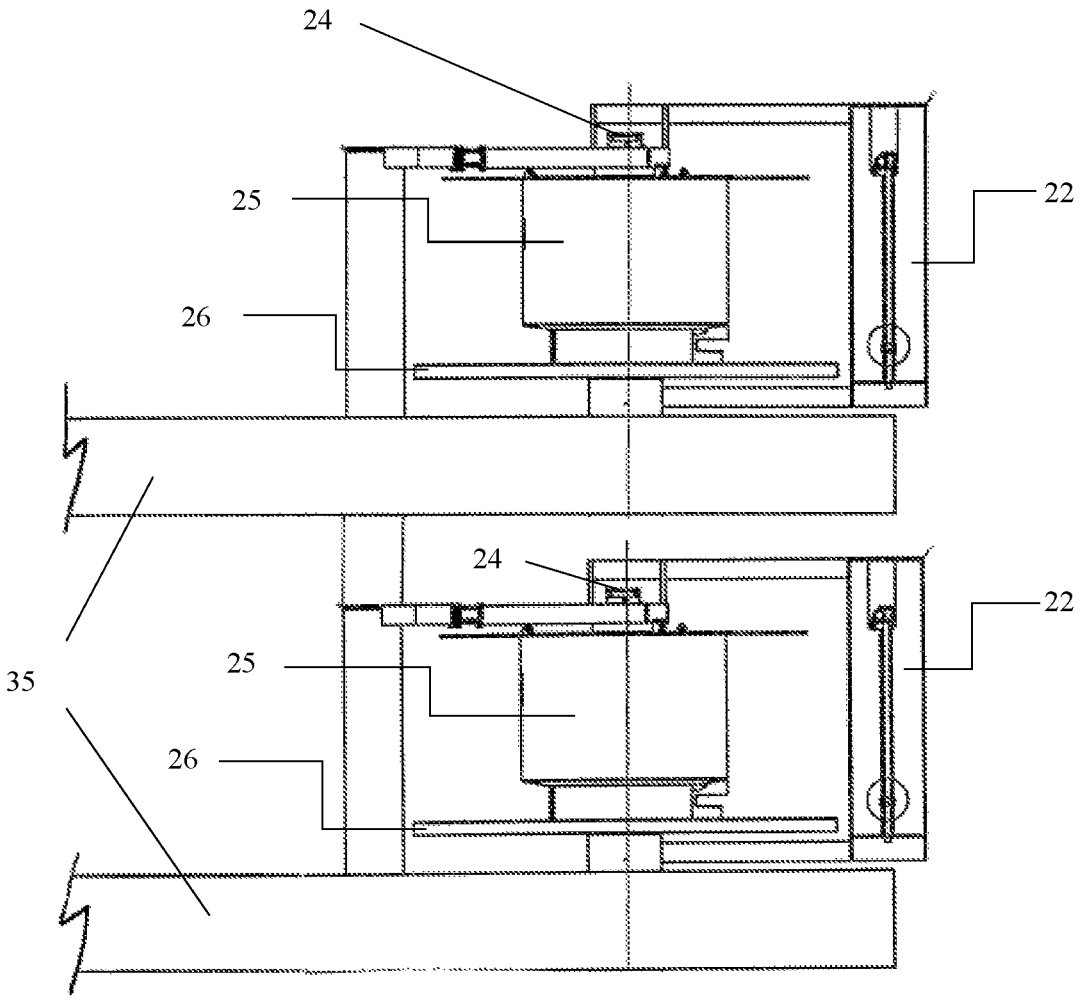
FIG. 11 shows a principal arrangement of vertical stacking of two hawser winches.

FIG. 11 shows a close-up of the arrangement of the two mooring winches 21 in FIG. 10. In this embodiment the axle 24 of rotation is vertical. The two winches can in one embodiment be individually operated, while in another embodiment they can be simultaneously operated. The fairleads 22 will rotate around the axle 24 together with the drum 25 and follow the direction of the mooring hawser 6, when the hawser 6 is connected to the tandem tanker 2.

Figure 12:
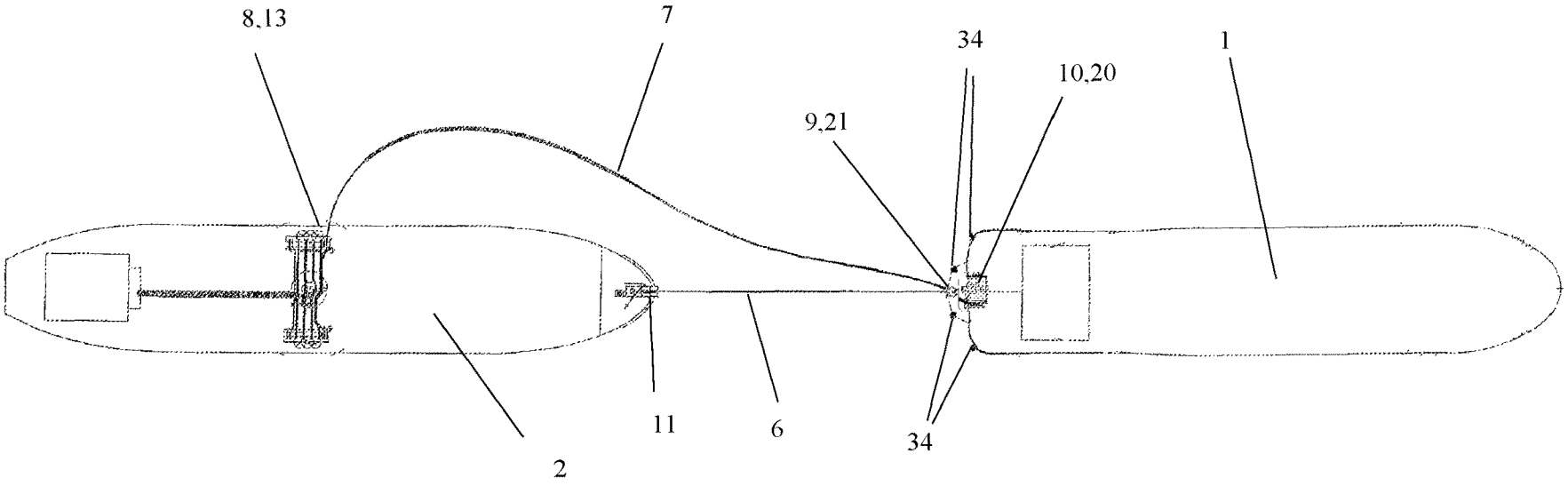
FIG. 12 shows a normal situation for tandem loading with minimal or no contact between hawser and hawser guides.

FIG. 12 shows a situation with the tandem tanker 2 in the nominal position relative the moored tanker 1. In this situation the direction of the mooring hawser 6 is parallel with the longitudinal direction Y of both vessels. The hawser is free from any contact with any guide structures 34.

Figure 13:
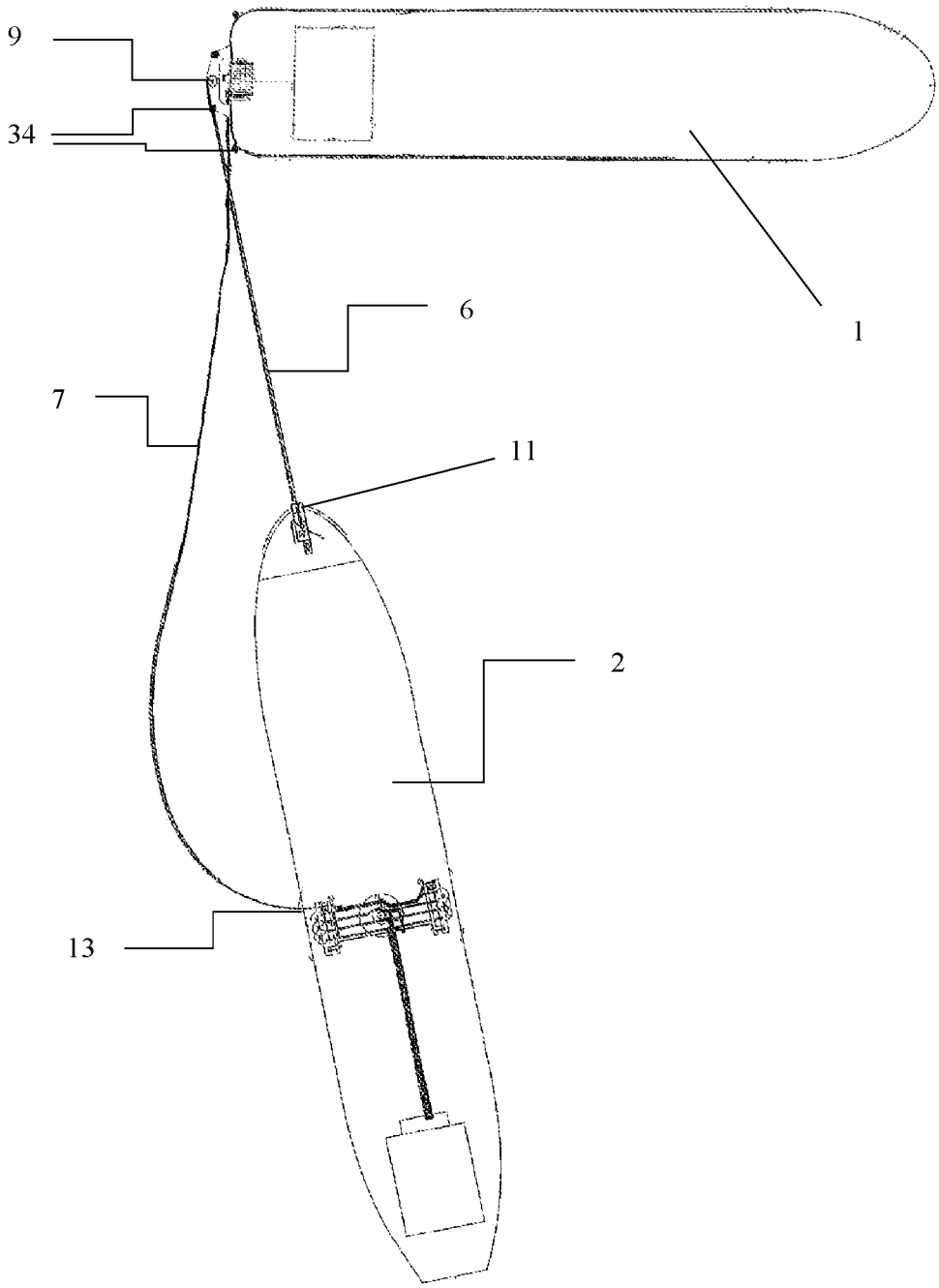
FIG. 13 shows an extreme situation for tandem loading with some contact between hawser and hawser guides.

FIG. 13 shows a situation where the tandem tanker 2 has a heading slightly above 90 degrees relative the moored vessel 1. In this situation the mooring hawser is in contact with parts of the guide structures 34. Further, the loading hose 7 drops vertically from the hose reel down to the sea surface and is thus crossing the mooring hawser 6 underneath the hawser, implying that there is no contact between the loading hose and mooring hawser even though they cross each other when looking from above.

Figure 14:
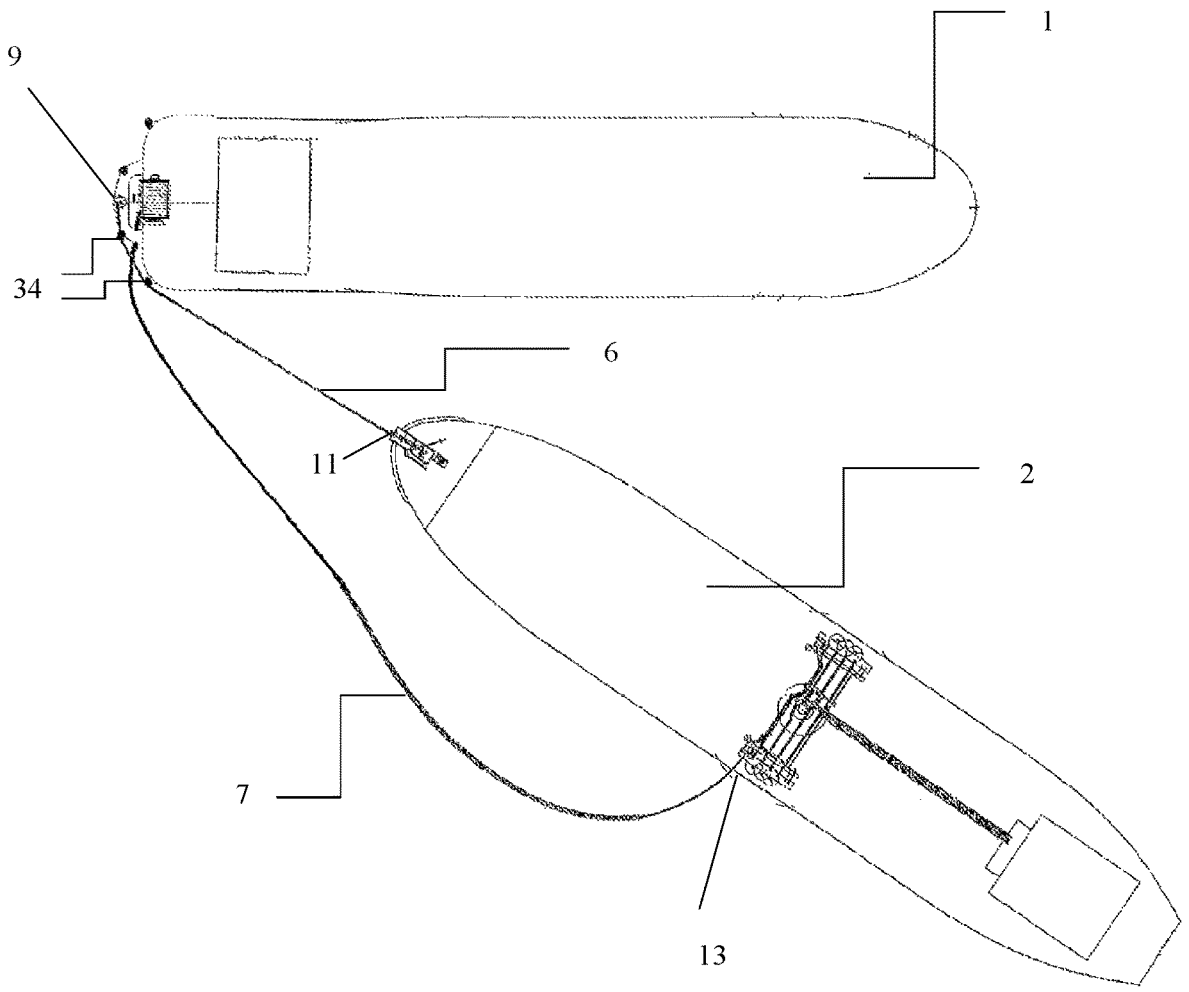
FIG. 14 shows a very extreme situation for tandem loading with significant contact between hawser and hawser guides.

FIG. 14 shows a situation where the tandem tanker 2 has a heading far above 90 degrees relative the moored vessel 1. In this situation the mooring hawser is in contact with all the guide structures 34 on the one side of the hawser connection arrangement 9.

Figure 15A:
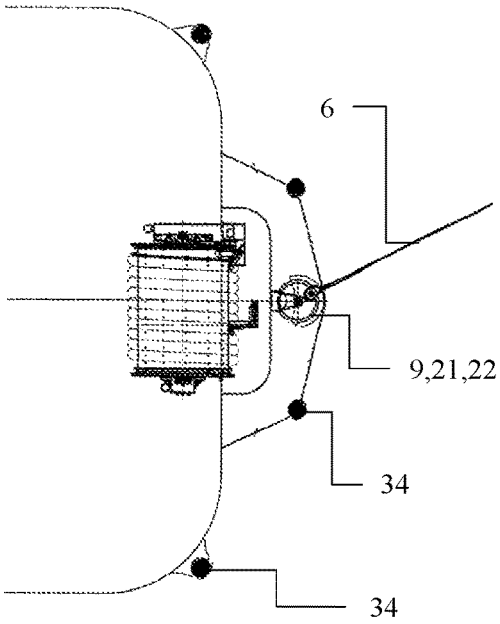
FIG. 15*a*-15*d* shows alternative configurations of hawser connection to moored vessel.
Figure 15B:
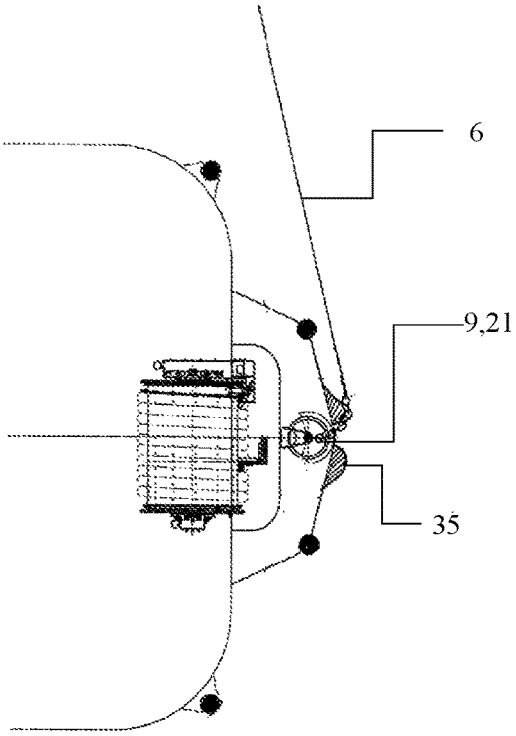
Figure 15C:
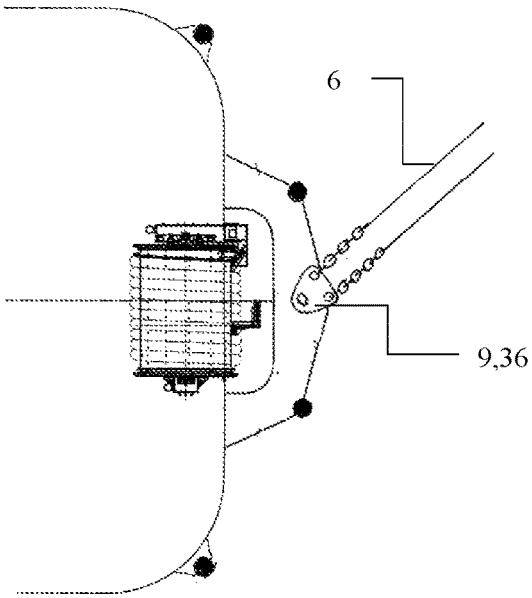
Figure 15D:
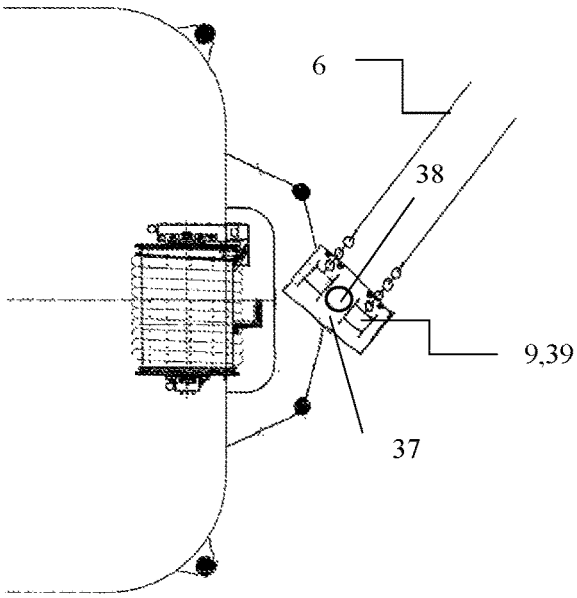

FIG. 15 shows four alternative arrangements for hawser connection to the moored vessel 1, whereof FIG. 15*a* is the same as described in FIGS. 10-14. FIG. 15*b* shows an alternative where the rotating fairlead in FIG. 15*a* is replaced with a fixed guide structure 35 that provides means to obtain the required variation of the hawser direction relative the moored vessel without damaging the hawser 6. In another embodiment the hawser winch 21 and fairlead 22 are replaced with a connecting element 36 with means to rotate around the vessel Z-axis such that it follows the hawser direction relative the moored vessel 1. A fourth alternative is shown in FIG. 15*d*, in which two hawser winches 39, each with a horizontal axle for rotation, are placed on a turntable 37, which rotates around the vessel Z-axis by the vertical turntable axle 38.

In an alternative embodiment of the invention the hawser connection arrangement 9 and thus the winches 21,39 or other means for connection of the hawser 6 to the moored vessel 1 is located side-by-side to other equipment such that the hawser has very limited freedom to rotate without interfering with this equipment. In this embodiment the guide structure 34 can be a solid plated structure in both vertical and horizontal direction that guides the hawser around this equipment. One example is shown in FIG. 16.

Figure 17A:
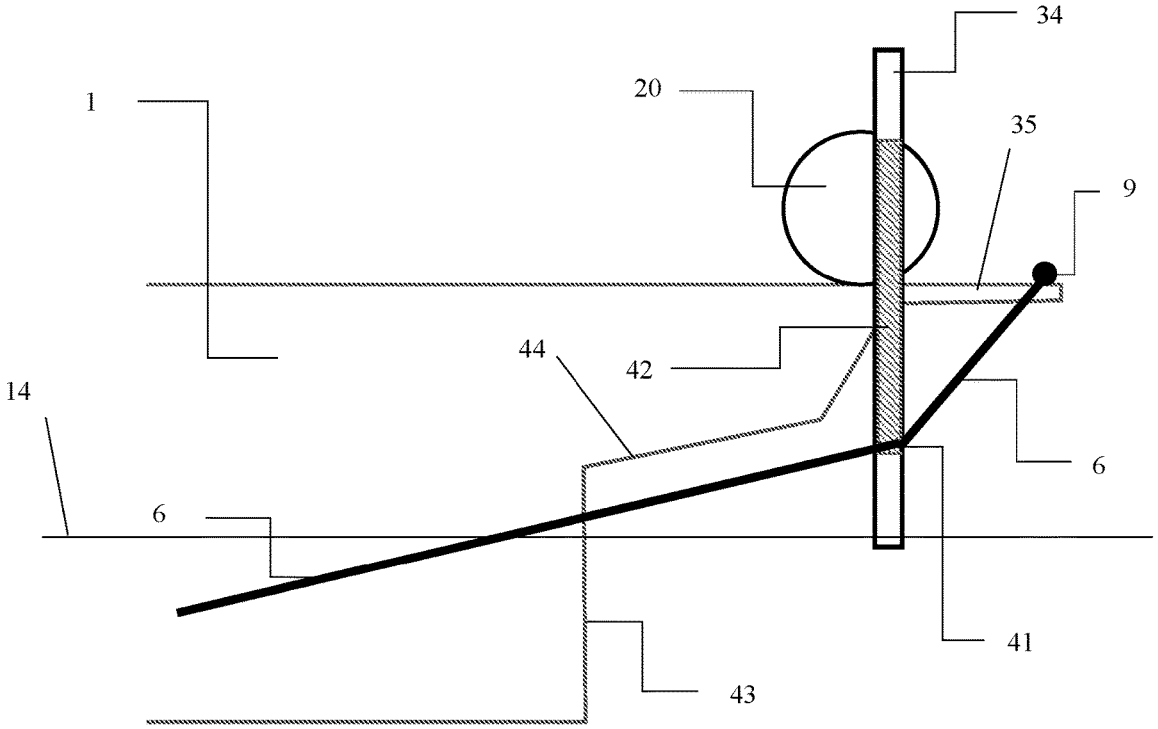
FIGS. 17*a* and 17*b* shows alternative inclinations of the guide structure.
Figure 17B:
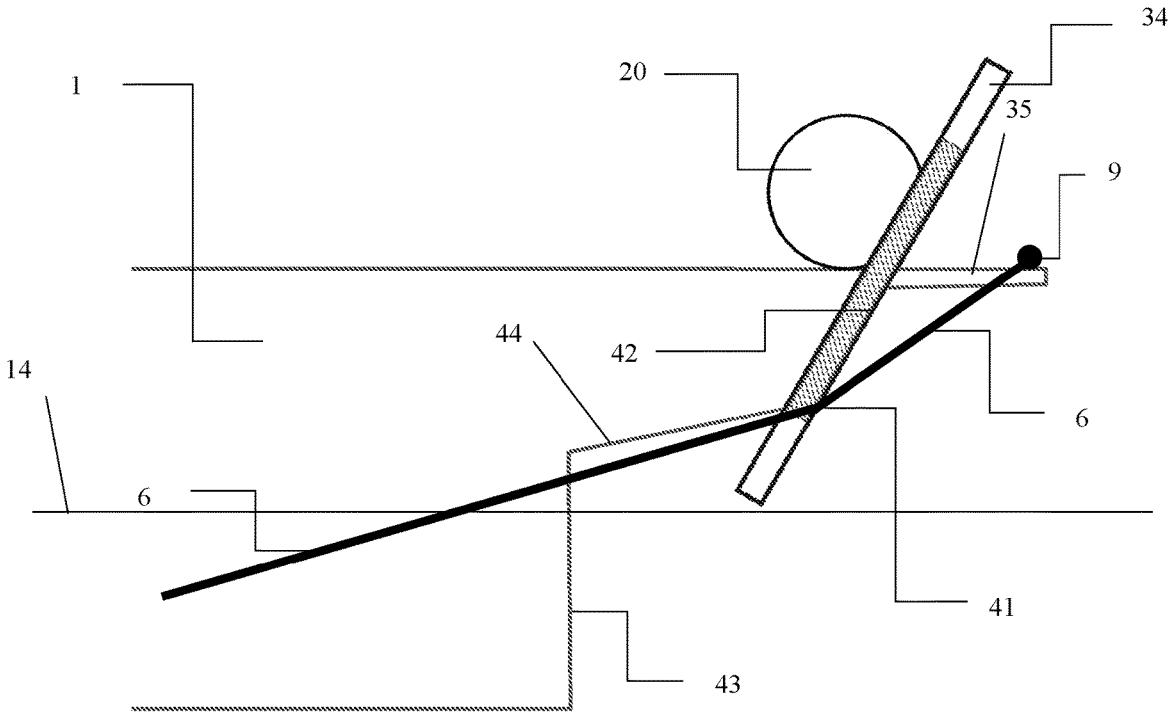

FIG. 17*a* shows an embodiment of the invention where the hawser guide structure has a vertical longitudinal axis. This embodiment is considered as the most beneficial since there is nothing that prevents the contact point 41 between the hawser 6 and guide structure 34 from moving up and down the guide structure along the potential contact area 42 when the two vessels moves relative each other in the vertical direction due to wave motions and draught variations. In another embodiment the guide structure 34 can have an inclination, such as shown in FIG. 17*b*. In said embodiment the longitudinal axis orientation may be substantially vertical or substantially horizontal or any orientation in-between vertical and horizontal, preferably the bottom end of the at least two guide structures 34 is tilted towards the hull of the first floating structure 1. With an inclination angle substantially different from vertical the hawser will not move as freely because it will be forced to also move in the horizontal direction when the two vessels move relative each other in the vertical direction. In the extreme scenario where the working area 42 of the guide structure is almost horizontal or partly horizontal, such as part 44 of the hull profile 43, the hawser may be locked from sliding along the guide structure because it has no possible to move in the vertical direction. Hence, the guide structure or the part of the hull 43 that potentially is in contact with the hawser should preferably be vertical or have an inclination that does not significantly differ from vertical.

The same principals apply to the hull profile 43 or external guide structure for the part of the hose 7 floating on the sea surface 14. If the floating part of the hose gets underneath a horizontal or close to horizontal part of the hull 44 then it can get squeezed between the waterline and the hull and thus be damaged. The shape of the hull or the potential guide for the hose in the area where the hull varies between being wet and dry should thus be vertical or close to vertical. In one embodiment the hose guide can be obtained by a proper shape of the hull 43, while in another embodiment it can be an external guide structure. This external guide structure can be a separate structure for the hose only, or it can be an extended part of the hawser guide structure 34, wherein the bottom end of the hawser guide structure extends to the waterline or below the waterline of the first vessel 1.

Although specific embodiments of the invention have been described and illustrated herein, it is recognized that modifications and variations may readily occur to those skilled in the art, and consequently, it is intended that the claims be interpreted to cover such modifications and equivalents.

REFERENCE NUMERALS

1 Moored vessel, i.e. vessel equipped with loading station
2 Tandem vessel, i.e. vessel connected in tandem to vessel with loading station
3 Tug
4 Turret
5 Mooring line
6 Mooring hawser
7 Loading hose
8 Midship manifold
9 Hawser connection arrangement on moored vessel
10 Hose connection point on moored vessel
11 Hawser connection point on tandem vessel
12 Tug line
13 Hose connection point on tandem vessel
14 Sea surface
15 Sea floor
16 Anchor
17 Riser between moored vessel and sea bed structures and manifolds
18 Loading station
19 Riser balcony
20 Hose reel
21 Hawser winch with vertical axis of rotation
22 Hawser fairlead
23 Hose drop-down location
24 Axle for hawser winch drum
25 Hawser winch drum
26 Hawser resting plate in vertical direction, when hawser is stored on drum
27 Chain
28 Rope
29 Pick-up/transfer line
30 End towards moored vessel
31 End towards tandem vessel
32 Limiting hawser direction
33 Allowable working area for hawser direction
34 Hawser guide
35 Hawser winch support structure
36 Connecting link or triplate
37 Turntable
38 Turntable axle for rotation about vertical axis
39 Hawser winch with horizontal axis of rotation
40 Fluid swivel
41 Hawser contact point on guide structure
42 Hawser potential contact area/working area on guide structure
43 Generic hull shape of moored vessel
44 Part of hull with an almost horizontal profile
45 Attachment area for hawser winch support structure towards vessel hull
46 Beam structure between attachment areas

The invention claimed is:

1. A system for restriction of hawser movement in a tandem mooring and loading system comprising:

a first floating structure being spread moored, and;

a second floating structure, and;

a tandem mooring arrangement between the first floating structure and the second floating structure comprising:

at least one hawser connected in a first end to a hawser connection arrangement having a stationary attachment point on the first floating structure, and in a second end connected to a hawser connection point on the second floating structure, and;

a loading arrangement wherein the system comprises a hawser guide arrangement, wherein the hawser guide arrangement comprises:

at least two guide structures situated on either side of the hawser connection arrangement and on an outside of an aft starboard side and an aft port side of a vessel hull on the first floating structure, for allowing a weathervanning sector larger than 180 degrees by hindering the at least one hawser from crossing over a deck portion of the first floating structure when the second floating structure weathervanes relative to the first floating structure wherein the at least two guide structures each have a vertical height extending from a bottom end below the hawser connection arrangement to a top end above the hawser connection arrangement, wherein a minimum height of the at least two guide structures is adapted to a vertical working range of the at least one hawser at a location of the at least two guide structures.

2. The system according to claim 1, wherein the at least two guide structures each have a curved surface adapted to be in contact with the hawser, wherein the curved surface has a radius that is larger than a minimum allowable bending radius of the hawser.

3. The system according to claim 2, wherein the bottom end of each of the at least two guide structures is tilted towards the vessel hull of the first floating structure.

4. The system according to claim 1, wherein the at least two guide structures are columns with a circular or oval cross section.

5. The system according to claim 4, wherein the bottom end of each of the at least two guide structures is tilted towards the vessel hull of the first floating structure.

6. The system according to claim 1, wherein the at least two guide structures are curved plates, each with a horizontal width extending from a first side end facing the hawser connection arrangement and to a second side end extending past a horizontal extremities of the vessel hull of the first floating structure.

7. The system according to claim 1, wherein the at least two guide structures each have a vertical longitudinal axis.

8. The system according to claim 1, wherein the bottom end of each of the at least two guide structures is tilted towards the vessel hull of the first floating structure.

9. The system according to claim 1, wherein the at least two guide structures are fixed to the outside of the vessel hull of the first floating structure.

10. The system according to claim 1, wherein the hawser connection arrangement comprises at least one hawser winch with a vertical axis of rotation.

11. The system according to claim 1, wherein the hawser connection arrangement comprises at least one hawser winch with a horizontal axis of rotation.

12. The system according to claim 1, wherein the loading arrangement comprises a hose reel on the deck portion of the first floating structure, a loading hose and a hose connection point on the second floating structure.

13. The system according to claim 12, wherein the hawser connection arrangement is situated on a support structure protruding from the vessel hull of the first floating structure.

14. The system according to claim 13, wherein the support structure comprises at least first and second attachment areas horizontally spaced on either side of the hose reel on the vessel hull of the first floating structure, forming a beam structure between the at least first and second attachment areas, and where the beam structure between the at least first and second attachment areas is spaced a distance away from the vessel hull of the first floating structure, forming an open space between the vessel hull and the support structure and the at least first and second attachment areas, wherein said open space defines a drop-down location for the loading hose.

15. The system according to claim 13, wherein the hawser connection arrangement comprises a turntable rotably mounted on a turntable axle with a vertical axis of rotation, wherein the turntable axle is situated on the support structure.

16. The system according to claim 13, comprising at least four guide structures, wherein at least two guide structures are situated on either side of the hawser connection arrangement on the support structure.

17. The system according to claim 1, wherein the bottom end of each of the at least two guide structures extends to a waterline of the first floating structure or below the waterline of the first floating structure.

* * * * *